US007497400B2

(12) United States Patent
Skinner

(10) Patent No.: US 7,497,400 B2
(45) Date of Patent: Mar. 3, 2009

(54) HELICAL HOSE AND CADDY COMBINATION

(76) Inventor: Martin J. Skinner, 103 Lake View Point, Harriman, TN (US) 37748

( * ) Notice: Subject to any disclaimer, the term of this patent is extended or adjusted under 35 U.S.C. 154(b) by 1 day.

(21) Appl. No.: 11/619,597

(22) Filed: Jan. 3, 2007

(65) Prior Publication Data

US 2007/0108332 A1 May 17, 2007

Related U.S. Application Data

(63) Continuation-in-part of application No. 11/087,963, filed on Mar. 23, 2005, now abandoned.

(60) Provisional application No. 60/556,049, filed on Mar. 23, 2004.

(51) Int. Cl.
*B65H 75/00* (2006.01)

(52) U.S. Cl. ..... 242/588.2

(58) Field of Classification Search ..... 242/405, 242/405.1, 405.2, 402, 401, 586, 588.2, 597.7, 242/597.8, 588, 407.1, 607, 405.3, 406; 137/355.16, 137/355.2, 355.23, 355.26, 355.27; 248/80, 248/519; 211/60.1, 70.6, 196, 205; 446/486; 224/42.37, 162

See application file for complete search history.

(56) References Cited

U.S. PATENT DOCUMENTS 241,961 A * 5/1881 Gilbert ..... 242/586
3,920,050 A 11/1975 Nichol et al.
4,576,350 A * 3/1986 Bond ..... 248/97
4,934,625 A 6/1990 Richardson
4,997,997 A 3/1991 Moore
5,409,177 A * 4/1995 Parry et al. ..... 242/421
5,429,321 A 7/1995 Skyba
5,964,412 A 10/1999 Thomas
6,209,800 B1 4/2001 Thomas
6,772,793 B2 * 8/2004 Warning ..... 137/899
6,877,701 B2 * 4/2005 Greubel ..... 248/87
6,883,537 B1 * 4/2005 Lin ..... 137/355.16
2001/0035473 A1 * 11/2001 Patton ..... 242/397.2
2005/0173582 A1 8/2005 Weck et al.

* cited by examiner

*Primary Examiner*—Peter M Cuomo
*Assistant Examiner*—William E Dondero
(74) *Attorney, Agent, or Firm*—Pitts & Brittian, P.C.

(57) ABSTRACT

An accessory is provided to include, in combination, a permanently coiled helical hose and a hose caddy therefore. Such helical hoses are formed from a plurality of equal convolutions forming the helix, with these convolutions defining a central volume. The hose caddy has a base member designed to normally rest on the ground or other supporting surface. A staff member extends substantially perpendicular to the base member, this staff being adapted to be loosley inserted into the volume formed by the convolutions. As a combination of hose and caddy, the accessory can be moved to any location where needed. In addition, the combination is easy to store without having additional apparatus.

20 Claims, 8 Drawing Sheets

HELICAL HOSE AND CADDY COMBINATION

CROSS-REFERENCE TO RELATED APPLICATIONS

This application is a continuation-in-part of application Ser. No. 11/087,963, filed on Mar. 23, 2005, which claimed the benefit of U.S. Provisional Application No. 60/556,049, filed Mar. 23, 2004.

STATEMENT REGARDING FEDERALLY SPONSORED RESEARCH OR DEVELOPMENT

Not Applicable

BACKGROUND OF THE INVENTION

1. Field of Invention

The present invention relates generally to coil hoses. More particularly, the present invention is related to a coil hose permanently formed into a helix, and to the combination of such a hose with a carrying and/or storage unit for such a hose.

2. Description of the Related Art

One of the more recent innovations in gardening equipment is the "Coil Hose" wherein the hose is permanently formed into a helix like a spring having uniform convolutions that define a central volume such that the hose can be extended or retracted much like the stretching and releasing of a helical spring. Some distributors call such hoses "recoil hoses". Such helical recoil or coil hoses are typically manufactured in lengths of 25 feet, 50 feet and 75 feet. Other lengths are, of course, possible. The internal diameter of such hoses ranges from about ⅜ inch to ⅝ inch, or larger. When retracted the many convolutions compact to 12 to 24 inches, depending upon the specified length. Each convolution is typically about 3 to 5 inches in diameter. These hoses are fabricated from plastic having a variety of colors: light or dark green, terracotta, yellow, etc. Such hoses are very useful when attached to a spigot at a house, garage, shed, or in the garden as they automatically retract into a very small "bundle" when not in use but can be stretched out to reach a watering position. Thus, they are very easy to use. Similar hoses are also used in various other applications, such as with compressed air tool systems and the like.

Despite the advantage of ease of use, these hoses exhibit problems in transport from one place to another or in their storage. These problems arise as the coil hoses act very much like a Slinky™ toy. If supported at ends, the center sags significantly. If supported near the center, the ends droop. Thus, the only way to move the coil hose from one location to another is to drag it across the ground. The same flexibility gives problems when trying to store the hose in the garage, shed, basement, etc.

Various efforts are reported in the literature to overcome the storage problem. One is a tray or "hammock" fastened to the wall of the storage area that supports the hose like a cradle. This is fine once the hose is in place; however, getting the flexible hose into the tray is not easy because of the extreme flexibility. Also, they are made to accommodate 25 foot hoses; if longer lengths are used, additional hammocks are requited. Another suggested solution is to hang a projecting arm from the wall and thread the coil hose onto this arm. To get the hose on this arm, a few coils (convolutions) at a time need to be threaded onto the arm: the weight of the remaining hose is always working against this operation. Still another device for the storage of a coil hose is a bellows-type sleeve, the length of which is adapted to hold the hose according to its length. The sleeve is adapted to be mounted on the wall of a structure where storage is to be effected. As with the other storage solutions, the flexibility of the coil hose hinders placing the hose within the sleeve. For all of these devices, the hose must be pre-drained before placement on or in the devices to prevent water draining during the positioning of the coil hose on the storage device.

Other devices have been developed to overcome these and similar problems associated with the collection, storage and transport of coil hoses. Typical of the art are those devices disclosed in the following U.S. Patents:

| Patent No. | Inventor(s) | Issue Date |
|---|---|---|
| 3,920,050 | G. D. Nichol et al. | Nov. 18, 1975 |
| 4,934,625 | C. D. Richardson | Jun. 19, 1990 |
| 4,997,997 | E. K. Moore | Mar. 5, 1991 |
| 5,429,321 | H. K. Skyba | Jul. 4, 1995 |

Of these patents, the '050 patent issued to Nichol et al., discloses a protective shroud for coil hoses for preventing the hose from becoming entangled. The '050 is further provided to prevent the hose from becoming entangled with other objects such as a user's clothing. The shroud consists of a pair of concentric coil springs wound in opposing directions. End fittings are provided for connecting the ends of the coils, and through which the ends of the coil hose are received. The hose is received within the '050 device and is not intended to be removed.

The '625 patent issued to Richardson discloses a holder and carrier for elongated flexible members such as rope, garden hoses or electrical cables. The '625 holder includes a planar base member having a top portion and a bottom portion. The top of the base member defines an opening which functions as a handle. Additional openings are provided to attach the base member to an existing wall structure. A pair of arms is attached to the bottom portion of the base member and function to retain a rope, hose or cable. The '625 device is removable from the wall structure such that the user can carry the device using the handle, with the elongated member being carried by the device.

Moore, in the '997 patent, discloses a coiled article retainer assembly comprising a generally planar rectangular body. The '997 device defines two arms, spaced from and generally parallel to each other, and defining an upper handle and a lower coiled article retaining slot. A keeper assembly, comprising a two way flap-type valve, is disposed at the open end of the retainer slot for permitting the paying in or out of individual coils by normal force exerted by hand, yet has sufficient resistance to restrain individual coils of a coiled article from falling out of a fully loaded slot due the weight of the coils.

Skyba, in the '321 patent, discloses a device for receiving, storing and dispensing a flexible elongated article with a generally uniform diameter such as a rope, electrical cord or hose. The '321 device includes a body portion containing a slot for sequentially receiving single loops of the elongated article. The width of the slot at its narrowest portion is sufficiently less than the diameter of the elongated article to restrain movement thereof along the lineal axis of the elongated article while permitting insertion and removal of the article in the slot in a direction perpendicular to that axis.

BRIEF SUMMARY OF THE INVENTION

The present invention is a coil hose and caddy combination provided by a base member configured to rest against any support surface, such as a floor, lawn, etc., with an upstanding staff extending through the central cavity or volume formed within the convolutions of the coil hose. With the coil hose thus received about the staff, the combined unit is movable to any location where a hose is desired. Furthermore, when the hose is not needed, the combined unit is stored at any location. The base member can be of any configuration, and the shaft member can be removable from the base member if desired.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

The present invention includes a hose caddy for retrieving and storing a coil hose defining a series of convolutions. The hose caddy is illustrated generally at 10 in the figures. The coil hose is illustrated generally at 12 in the figures. The hose caddy 10 is provided for gathering the hose 12 thereon in a manner such that the hose 12 and caddy 10 are easily transported and stored. Further, the hose caddy 10 is configured such that the hose 12 is readily and easily dispensed at any selected location.

Figure 10A:
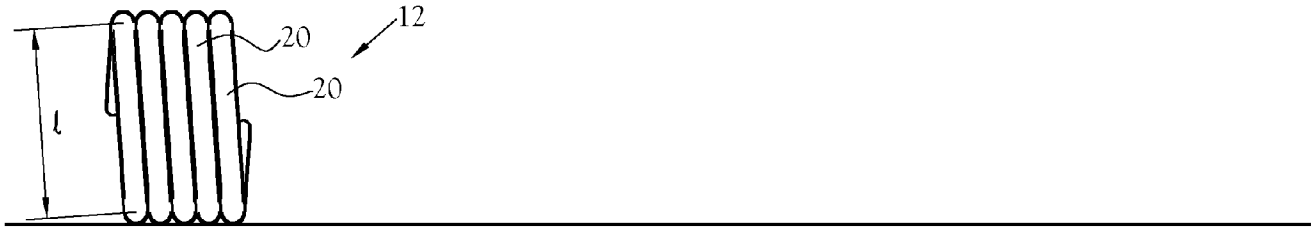
FIGS. 10A-C is a series of side elevation views of several uniform convolutions of the coil hose of the present invention in a progression of extensions.
Figure 10B:
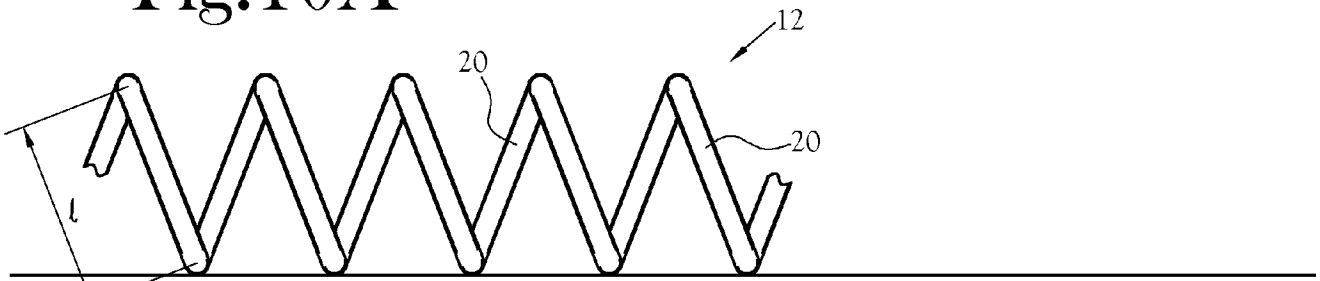
Figure 10C:
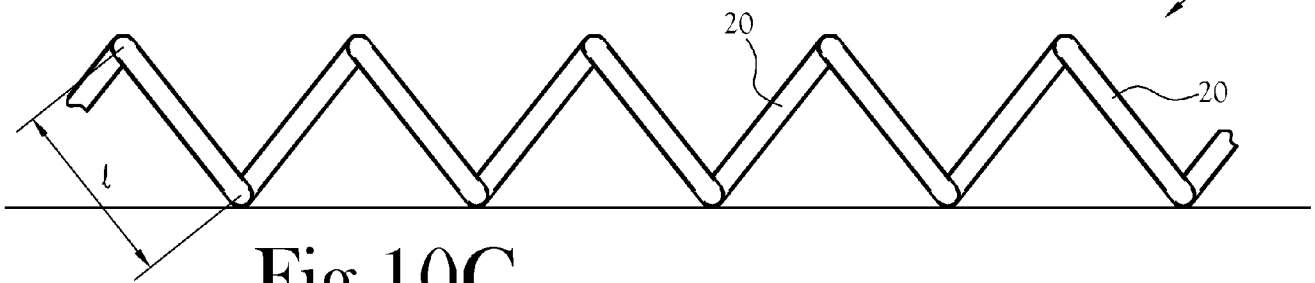

Referring now to the figures, in which like reference numerals indicate like or corresponding features, there is depicted in FIGS. 10A-C several convolutions 20 of the coil hose 12 of the present invention in a progression of extensions. Illustrated in FIG. 10A, the several convolutions 20 of the coil hose 12 are illustrated when not in use and lying on a support surface 16. As illustrated in FIG. 10B, when the coil hose 12 is extended, the convolutions 20 separate from each other, but maintain their general shape and diameter. In a substantially extended position of the coil hose 12, as illustrated in FIG. 10C, the convolutions 20 separate further. As illustrated, in all degrees of extension, the coil hose 12 retains its helical configuration.

Figure 1:
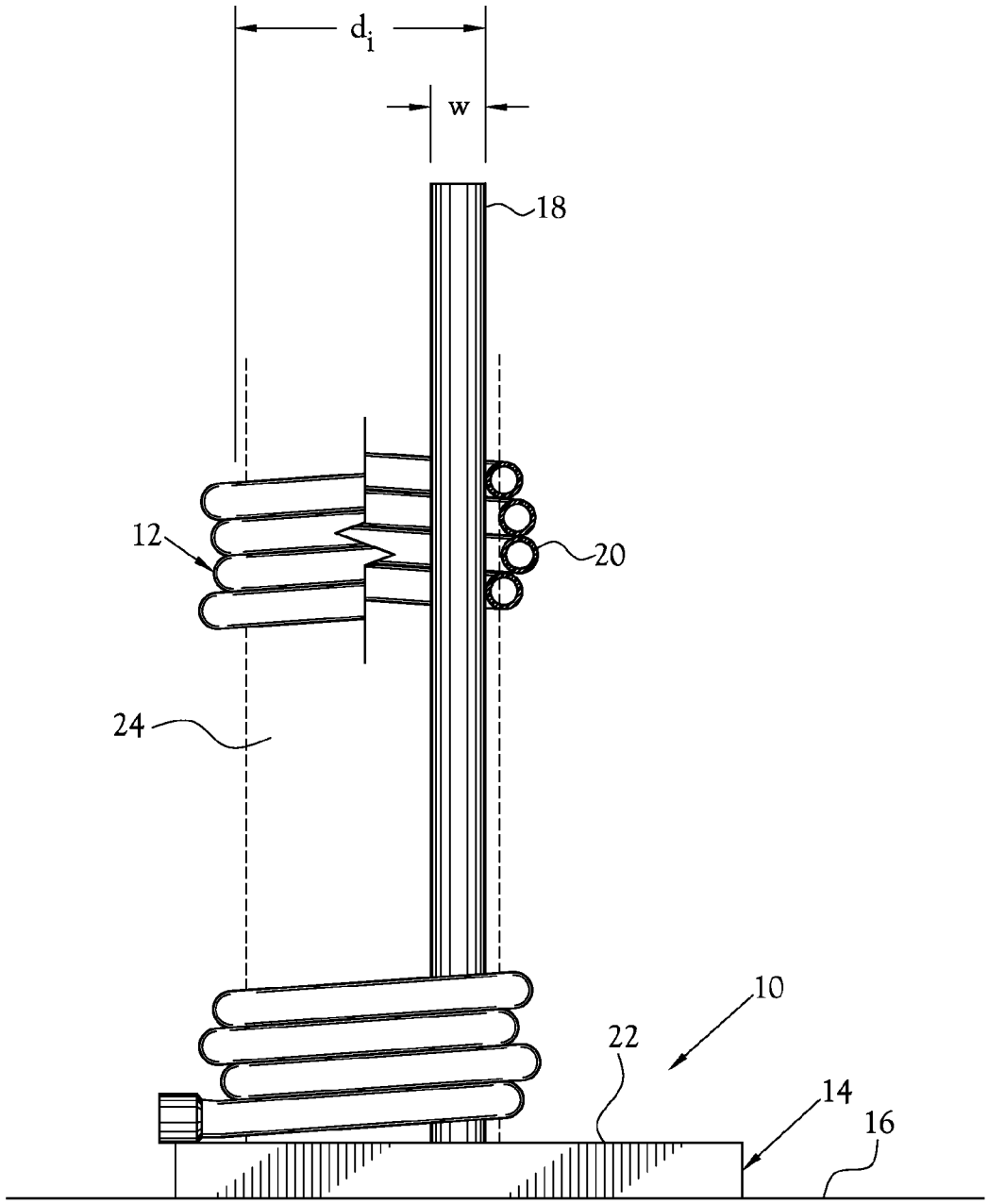
FIG. 1 is a front elevation view of one embodiment of the present invention showing the coil hose in a stored position upon the hose caddy.

FIG. 1 illustrates the basic construction of the hose caddy 10 of the present invention. There is a hose caddy 10 and a coil hose 12 held by that caddy. The caddy 10 has a base member 14 for support upon a support surface 16 such as a floor, a work surface, or the like. A staff member 18 is carried by and extends upwardly from the base member 14. The staff 18 is adapted to be loosely received within convolutions 20 of the hose 12. Although the staff member 18 is shown as being positioned substantially in the center of and at a right angle with respect to the top surface 22 of the base member 14, the only requirement is to have this staff member 18 positioned so that it and the stored hose 12 have a center of gravity within the area of the base member 14. The staff member 18 can have any cross-sectional configuration. In the illustrated embodiments, the staff 18 defines a cylindrical cross-section. The cross-sectional geometry of the staff member 18 is dimensioned to be loosely received within the central volume 24 defined within the convolutions 20 of the coil hose 12. The coil hose 12 is positioned upon the staff member 18 either manually or, preferably, by passing the staff member 18 through the central volume 24 while the coil hose 12 is on the supporting surface 16. More specifically, the staff member 18 has a transverse dimension w that is substantially smaller than the inner dimension d; of the convolutions 20. This relationship provides a loose fit and allows a user to hold the caddy and easily insert the staff member into the central volume 24 of the coil hose 12 lying on the support surface (i.e., the ground) while requiring little or no contact with the coil hose. By reducing or eliminating the amount of required contact with the coil hose, potential annoyances such as becoming soaked by water draining from the coil hose are minimized. As illustrated in FIG. 1, a compact combination is created for ease in moving the unit to any desired location for use of the hose 12 or for storage thereof. In this and other embodiments of the present invention, the components of the hose caddy 10 are fabricated from any suitable material, such as wood, rigid plastic, metal or combinations of materials.

Figure 2:
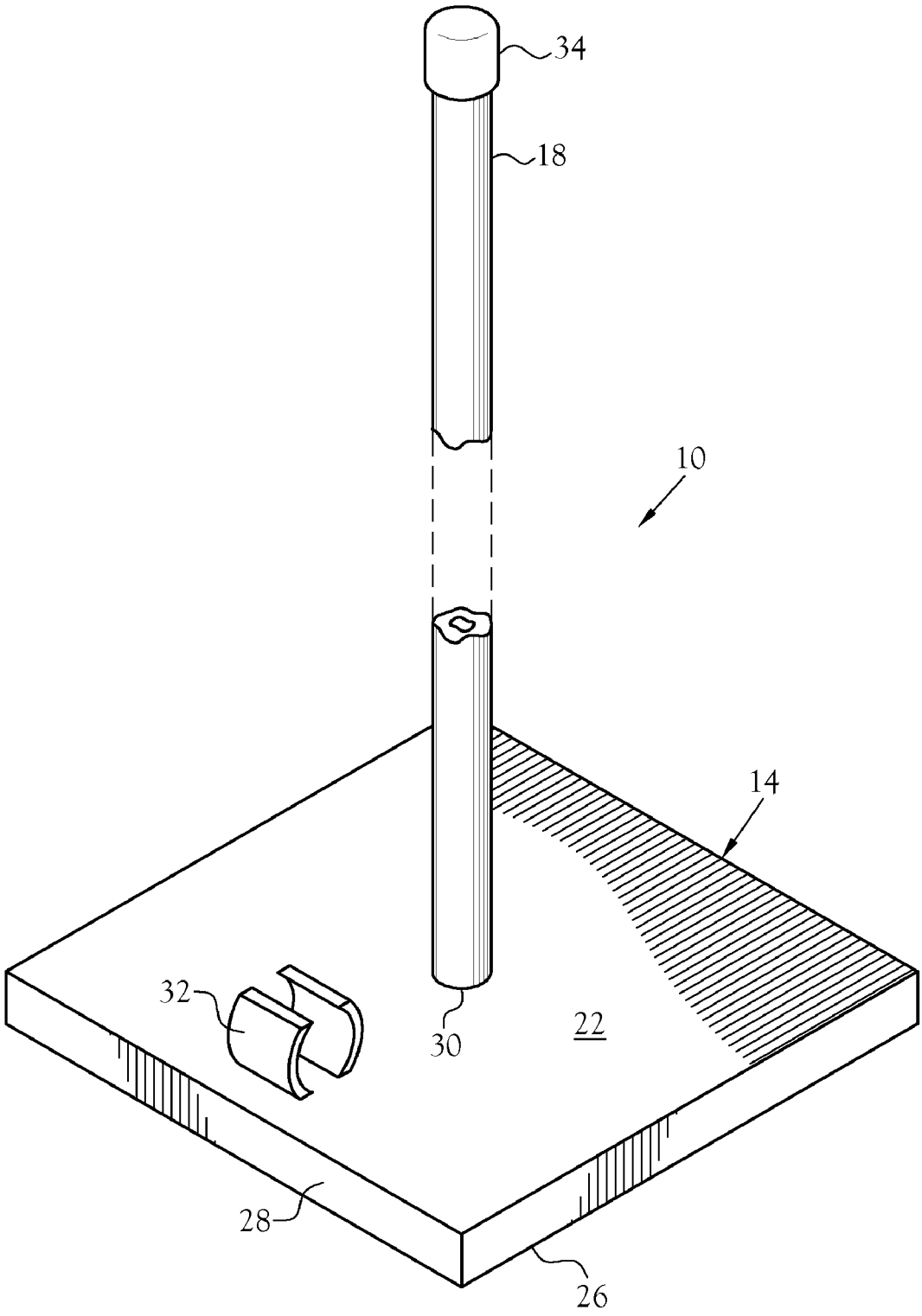
FIG. 2 is a perspective view of one embodiment of a base member and staff of the hose caddy of the present invention.

Shown in FIGS. 2-7 are some alternate configurations of the base member 14 of the present invention (absent the coil hose for simplicity). In FIG. 2, the base member 14 is substantially rectilinear in shape. A bottom surface 26 is that which contacts the support 16, while the top surface 22 is, in the illustrated embodiment, substantially parallel to the bottom surface 26. The four edges 28 complete the surface of the base member 14. As shown, the staff member 18 projects from the top surface 22. The staff member 18 is mounted on the base member 14 using any conventional fashion. In the illustrated embodiment, the lower end of the staff member 18 is received with a recess 30 in the base member 14 and secured therein using any fixed or releasable manner. However, it will be understood that the staff member 18 and base member 14 may be integrally formed.

Further illustrated in FIG. 2 is a clasp 32 attached to the top surface 22 of the base member 14. This clasp 32, or other means (e.g., a recess) provides for the releasable holding of a hose nozzle (not shown). Also illustrated is a knob or other grasping element 34 at the distal end of the staff 18. This element 34 facilitates grasp of the hose caddy 10 during transport thereof. While shown as being cylindrical, this element 34 can have any desired configuration and construction.

Figure 3:
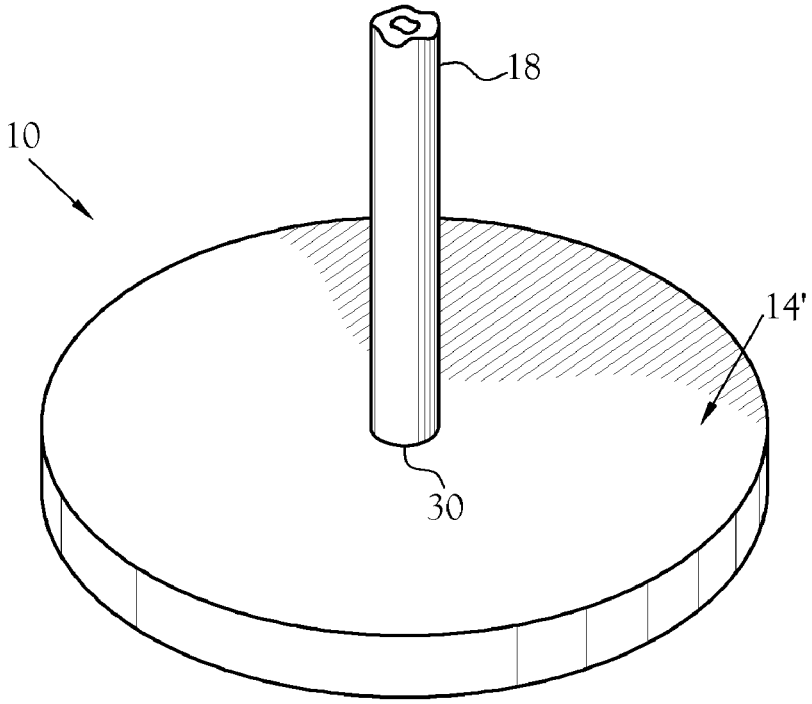
FIG. 3 is a perspective view of another embodiment of a base member and staff of the hose caddy of the present invention.

FIG. 3 is a similar construction except that the base member 14' defines a circular configuration. To this end, it will be seen by those skilled in the art that the base member 14 of the present invention may define any selected geometric configuration. In all other respects, this embodiment is like that of FIG. 2.

Figure 4:
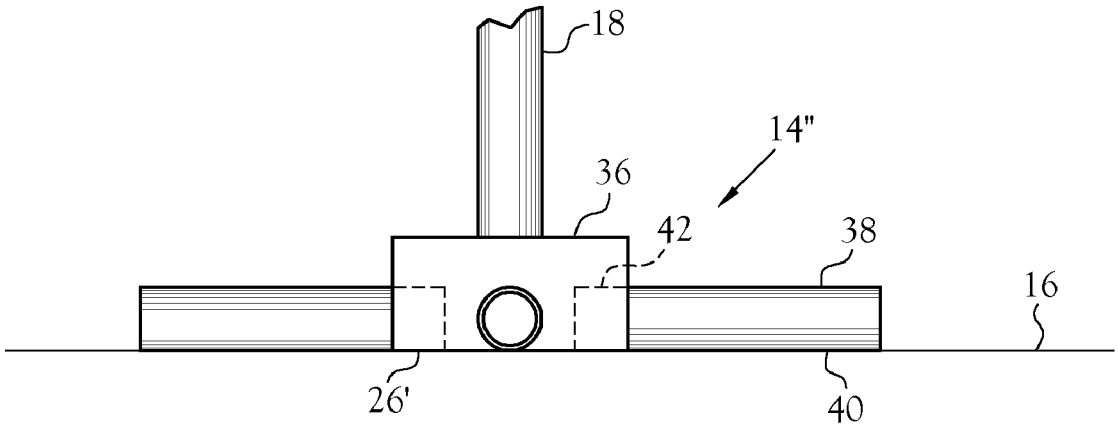
FIG. 4 is a front elevation view of a further embodiment of a base member and staff of the hose caddy of the present invention.
Figure 5:
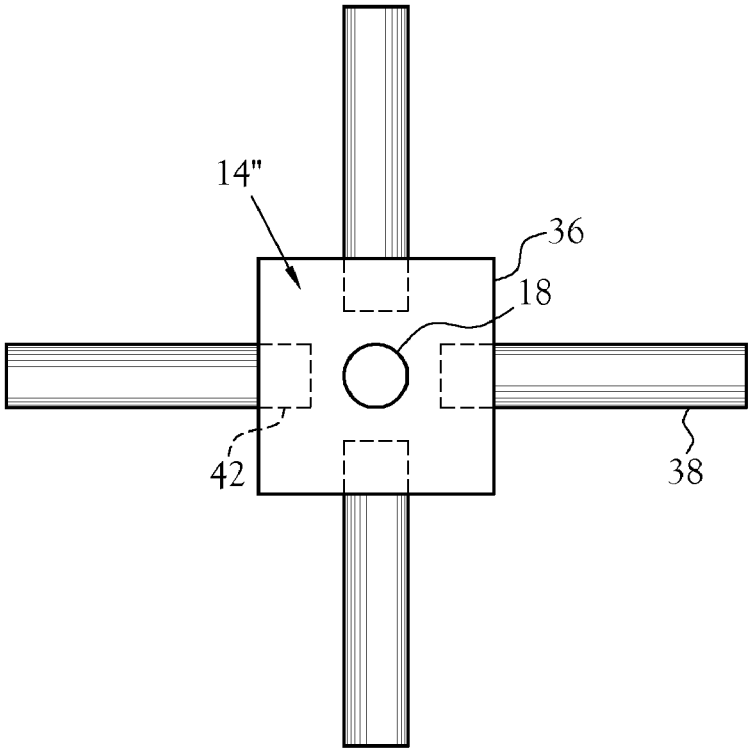
FIG. 5 is a top view of the embodiment of FIG. 4.

In FIGS. 4 and 5, this embodiment has a base member 14" with a central body member 36 with a stabilizer extending therefrom. In these FIGS. 4 and 5, the stabilizer is a plurality of radially extending legs 38. The legs 38 of the illustrated embodiment define a circular cross-section. However, it will be understood that the legs 38 may define any cross-sectional configuration. The bottom surfaces 40 of each leg 38 form the bottom surface 26' of the base member 14". The central body member 36 of the illustrated embodiment is square. However, as with other elements of the present invention, the central body member 36 may define any selected geometric configuration. Although four legs 38 are illustrated, fewer or more than four may be incorporated to achieve stability on the support surface 16. The legs 38 are attached to the central body member 36 by inserting one end of each into a recess 42 defined by the central body member 36. It will be understood that other attachment means can be used, such as by gluing, welding, and the like. A first end of the staff member 18 is attached to the central body member 36 in a similar manner. Also, the legs 38 and/or the staff member 18 may be integrally with the central body member 38.

Figure 6:
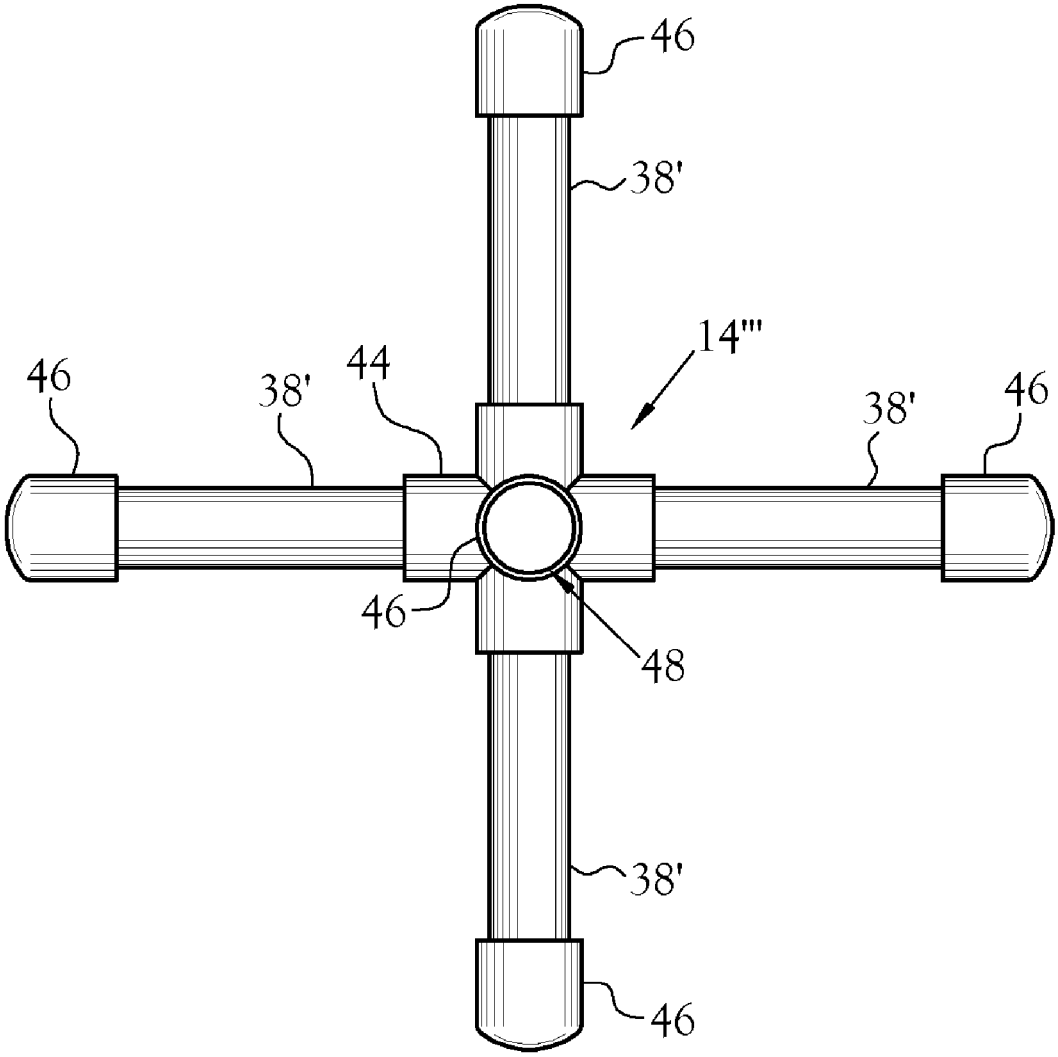
FIG. 6 is a top view of an alternative embodiment of a base member and staff member of the hose caddy of the present invention.
Figure 7:
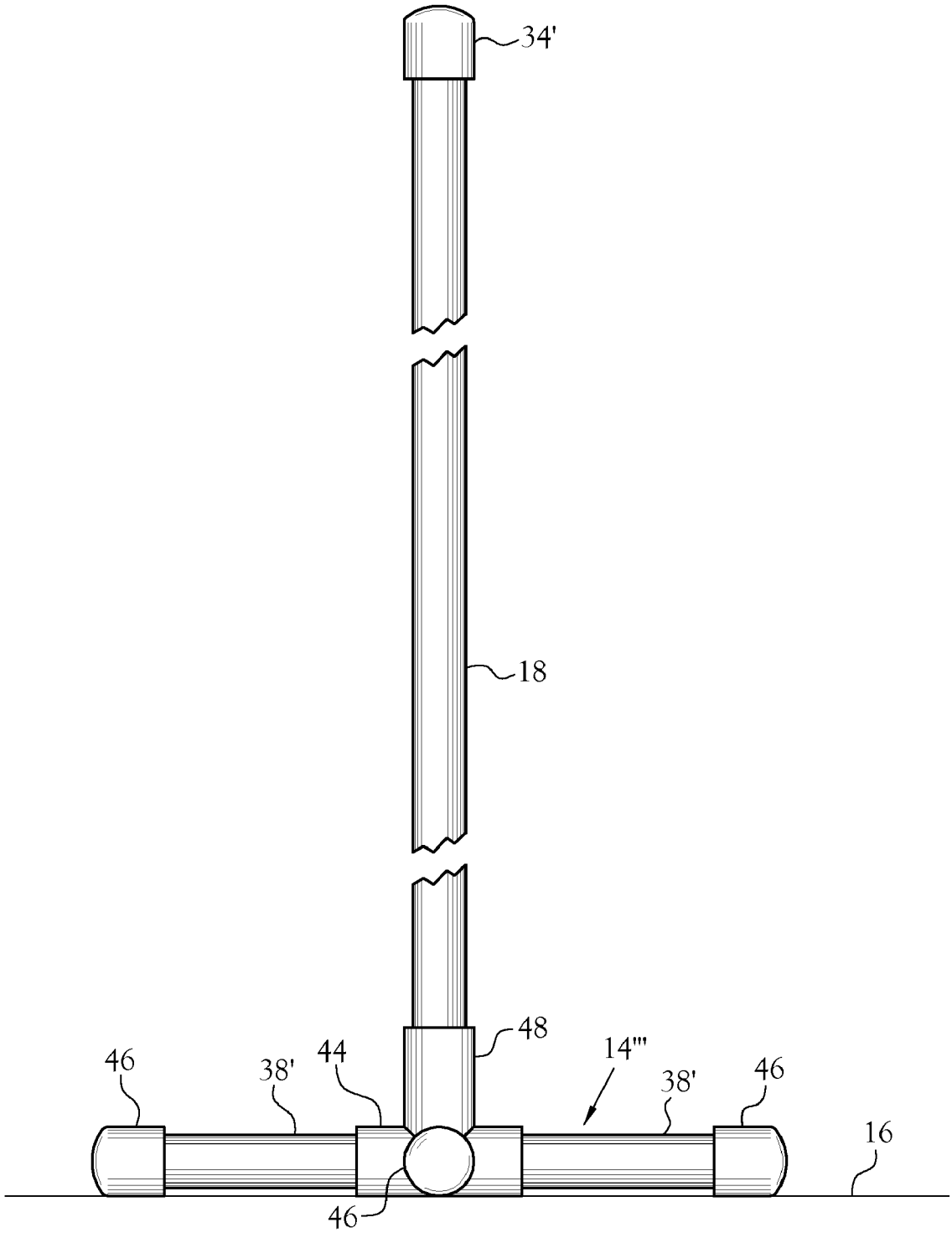
FIG. 7 is a front elevation view of the embodiment of FIG. 6.

FIGS. 6 and 7 illustrate the base member 14'" constructed from conventional rigid plastic pipe components. The advantage of constructing the hose caddy 10 of these plastic components is the low maintenance of such materials. Also, the components can be purchased readily and are light in weight. At the central position is a plastic four-way connector 44. The radial legs 38', formed from plastic pipe, have one end fitted within a socket of this connector 44, and each are capped with a cap member 46 whereby the wall thickness of the cap members 46 matches the wall thickness of the connector 44. A further socket member 48 is provided on the connector 44 providing a socket generally oriented perpendicularly to the legs 38'. This socket member 48 provides a socket to receive an end of the staff member 18, also formed from plastic pipe. The end of the staff member can also be received in an additional socket formed in the side surface of the connector 44. Typically the plastic pipe and the accompanying fittings, have a ½ inch internal diameter. However, it will be understood that any size pipe and fittings are useful for constructing this embodiment of the present invention. Various rigid plastic components can be utilized in the present invention, e.g. PVC, CVPC, etc. Typically, the legs 38' are four to five inches in length, and the staff member 18 is typically eighteen to thirty inches in length. Of course, other sizes and lengths are considered to be within the scope of the present invention.

Figure 8:
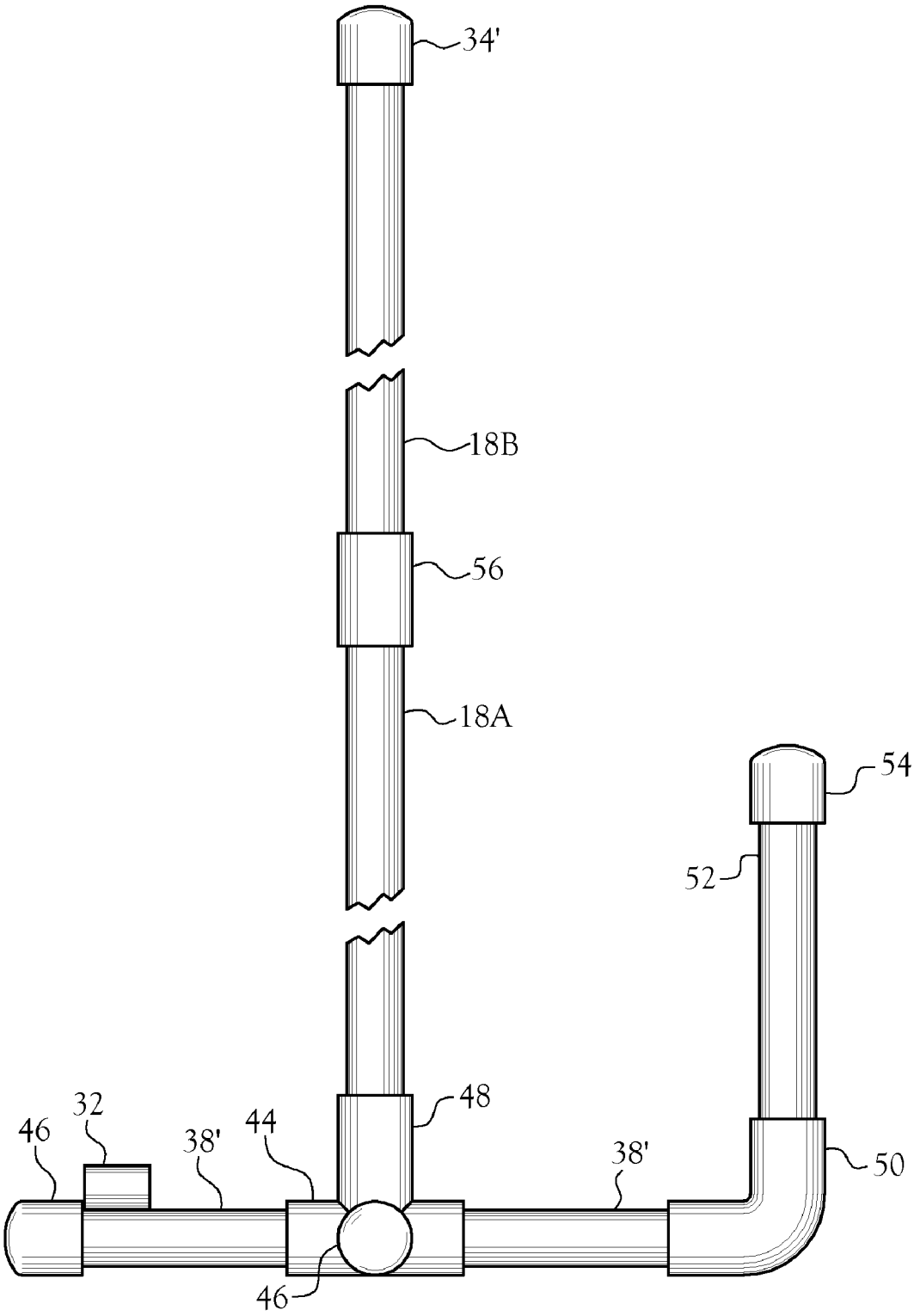
FIG. 8 is a front elevation view of a modification of the embodiment of FIG. 7.

FIG. 8 is a front elevation view of a variation of the embodiment of FIG. 6. In this variation, one cap member 46 is replaced with a plastic elbow 50 oriented to be directed upwardly relative to the legs 38'. Although illustrated as a 90 degree elbow 50, other elbow configurations are within the scope and spirit of this embodiment of the invention. Inserted into the second socket of the elbow 50 is a short piece of plastic pipe to form a carrying handle 52. This handle 52, which is exterior to convolutions 20 of the hose 12 when on the staff member 18, can be provided with a separate cap member 54. It will be recognized that a similar handle can be combined with the other embodiments of the present invention. In this embodiment is illustrated dividing the length of the staff member 18 into at least two sections 18A and 18B. The sections are joined in conventional fashion such as with a coupling 56. This feature, which facilitates the shipping of the components, is applicable to all of the embodiments of the present invention. Of course, other divisions in the length of the staff member 18 are within the scope of the present invention. Further, if longer hoses are to be carried on the hose caddy 10, additional lengths can be added to the staff member 18.

In the embodiments of FIGS. 6-8 the components are joined with a friction fit such that components, including the staff member 18, are removable. It will also be understood that the various components may be permanently secured one to another with conventional means (e.g., glue) as desired. As in FIG. 2, the embodiments of FIGS. 3-8 may be provided with a clip or clasp 32 attached to one of the legs 38 or 38' as illustrated in FIG. 8 for the releasable retention of a hose nozzle (not shown).

As mentioned above, the invention also embraces models where the staff member 18 can either be permanently attached to the base member 14 or can be releasably attached thereto. Permanent attachment can be accomplished by welding, gluing, etc.

Figure 9:
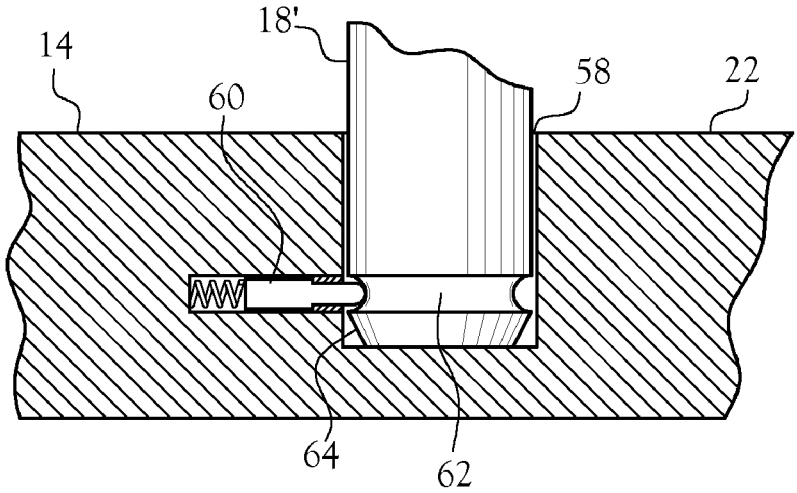
FIG. 9 is a cut-a-way drawing of a base member of the present invention that includes means for releaseably connecting a staff of the present invention to the corresponding base member to form the hose caddy.

In FIG. 9 one embodiment of a detachable shaft member 18' is illustrated. As depicted in FIG. 9, the base member 14 is provided with a cylindrical recess (assuming a staff member 18' of circular cross-section) 58 within, and oriented perpendicular to, the top surface 22. The wall of the recess 58 is provided with a detent member 60 of conventional construction. The external surface of the staff member 18' is provided with an encircling recess 62, this recess receiving the detent 60 when the staff member 18' is fitted within the recess 58 so as to retain the staff member 18' in an installed position. However, sufficient axial pull on the staff 18' causes disengagement between the detent member 60 and the recess 62 whereby the staff 18' is removed from the recess 58 if desired. The terminal end of staff member 18' is chamfered as at 64 whereby the detent member 60 is retracted as the staff member 18' is inserted into the recess 58 until mated with the encircling recess 62.

Referring again to FIG. 1, in a normal utilization of the present invention, the combination of hose 12 and hose caddy 10 is created by passing the staff member 18 into and substantially through the volume 24 defined by the hose convolutions 20. This is easily accomplished while the hose 12 is supported on the ground or other support surface 16 as the cross-sectional dimension of the shaft is less than the diameter of the convolutions 20. When in this upright position, for a hose 12 used as a watering hose, residual water within the hose 12 drains from the hose 12 before the hose-caddy combination is moved into a storage facility. There is no lifting of the hose 12 so that the hose 12 and the caddy 10 are put together in one unit. The hose caddy 10 can then be righted so that the base member 14 is supported upon the ground or other support surface 16. The combination thus is ready for transport to any location where the hose 12 is to be used, or to a storage location. When the hose 12 is to be used, the hose 12 and hose caddy 10 combination is transported to the use location. With the hose caddy 10 in a substantially horizontal orientation, the hose 12 is easily drawn off the staff member 18 for use.

Thus the combination of the coil hose and hose caddy provides for the easy transport and/of storage without having to deal with the flexibility of the hose. The combination can be moved to any place where a hose is desired, or to a storage place without the installation of a storage device.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, I claim:

1. A combination coil hose and caddy for retrieving, storing, and transporting said coil hose, said combination comprising:

a coil hose formed into a permanent helical configuration with a plurality of uniform convolutions, said plurality of convolutions defining a central volume, said convolutions having an inner diameter;

a caddy adapted to be self-supporting allowing said caddy to be moved by a user and temporarily placed on a selected substantially horizontal surface, said caddy comprising:

a staff member defining a first end and a second end, said staff member having a transverse dimension that is substantially smaller than said inner diameter of said convolutions along the entire length of said staff member thereby allowing said staff member freely to be inserted into and withdrawn from said coil hose while limiting the need for the user to handle said coil hose directly; and a base member having a bottom and top, said first end of said staff member being attached to said top of said base member, said staff member being held in a substantially vertical orientation when said bottom of said base member is placed on the selected substantially horizontal surface;

whereby said caddy is adapted for retrieving, storing, and transporting said coil hose.

2. The combination of claim 1 wherein said second end of said staff member extends out of the central volume of said coil hose to facilitate grasping of said second end for carrying said caddy when said coil hose is received thereon.

3. The combination of claim 1 wherein said base member is provided with means to releasably retain a hose nozzle.

4. The combination of claim 1 wherein said base member includes:

a central core member; and a plurality of legs carried by and extending radially away from said central core member, a bottom surface of said leg members defining a plane for contact with said support surface.

5. The combination of claim 4 wherein said central core member defines a plurality of cavities adapted to closely receive one each of said plurality of leg members, said central core member further defining a top aperture adapted to closely receive said first end of said staff member.

6. The combination of claim 4 further comprising a handle member attached to a distal end of one of said plurality of legs, said handle member having a grasping portion substantially parallel to said staff member and positioned forward of said base member top surface thereby allowing a user to hold said caddy and to retrieve said coil hose on said staff member.

7. The combination of claim 1 further comprising a handle member attached to said base member at a location whereby said handle member is exterior to the convolutions of the coil hose when said staff member is within the central volume of the coil hose, said handle member having a grasping portion substantially parallel to said staff member and positioned forward of said base member top surface thereby allowing a user to hold said caddy and to retrieve said coil hose on said staff member.

8. The combination of claim 1 wherein said staff member includes a plurality of axially aligned and separable sections.

9. The combination of claim 1 further comprising a grasping element carried by said second end of said staff member to facilitate transport of said caddy.

10. In combination, coil hose and a caddy for retrieving, storing, and transporting said coil hose, which comprises:

a coil hose formed into a permanent helical configuration with a plurality of uniform convolutions, said plurality of convolutions defining a central volume, said convolutions having an inner diameter;

a base member having a central core member and a plurality of radially projecting legs, said legs defining a plane adapted to be free-standing upon a support surface on which said caddy is positioned, said central core member defining a receptor in a top surface thereof; and a staff member carried by said base member and defining a first end and a second end, said first end being received within said receptor in said top surface of said central core member, said staff member having a transverse dimension substantially smaller than said inner diameter of said convolutions along the entire length of said staff member allowing said staff member to be freely inserted into said central volume of said coil hose for retrieving, storing, and transporting said coil hose, and further adapted and allowing said staff member to be easily withdrawn from said central volume;

whereby said base member and said staff member define said caddy for said coil hose, whereby said caddy allows retrieving, storing, and transporting said coil hose to and from any selected location without requiring substantial user contact with the coil hose.

11. The combination of claim 10 wherein said central core member is provided with four radially projecting legs equally spaced around said central core member, each leg having a distal end.

12. The combination of claim 11 wherein said central core member, said legs, and said staff member are fabricated from rigid plastic.

13. The combination of claim 10 further comprising a handle member attached to a distal end of one of said plurality of legs whereby said handle member is exterior to the convolutions of the coil hose when said staff member is within the central volume of the coil hose, said handle member having a portion substantially parallel to said staff member allowing a user to control said caddy while retrieving said coil hose.

14. The combination of claim 10 wherein said staff member includes a plurality of axially aligned and separable sections.

15. The combination of claim 10 further comprising a grasping element carried by said second end of said staff member to facilitate transport of said caddy.

16. In combination, a coil hose and a caddy for retrieving, storing, and transporting said coil hose, which comprises:

a coil hose formed into a permanent helical configuration with a plurality of uniform convolutions, said plurality of convolutions defining a central volume, said convolutions having an inner diameter;

a base member having a central core member and four equally-spaced, radially-projecting legs, said legs having bottom surfaces defining a plane adapted to contact a selected support surface on which said caddy is positioned, said central core member defining a receptor in a top surface thereof and a staff member carried by said base member and defining a first end and a second end, said first end being received within said receptor in said top surface of said central core member, said staff member having a transverse dimension substantially smaller than said inner diameter of said convolutions, along the entire length of said staff member said staff member adapted to freely fit within said central volume of said coil hose allowing said staff member to be easily inserted into said central volume of said coil hose for retrieving, storing, and transporting said coil hose, and further adapted to be easily withdrawn from said central volume;

whereby said base member and said staff member define said caddy for said coil hose.

17. The combination of claim 16 further comprising a handle member attached to a distal end of one of said plurality of legs whereby said handle member is exterior to the convolutions of the coil hose when said staff member is within the central volume of the coil hose, said handle member having a grasping portion substantially parallel to said staff member allowing a user to hold said caddy and to manipulate said staff member into position to retrieve said coil hose.

18. The combination of claim 16 further comprising a grasping element carried by said second end of said staff member to facilitate transport of said caddy.

19. The combination of claim 16 wherein said central core member, said legs, and said staff member are fabricated from rigid plastic.

20. The combination of claim 16 wherein said base member is provided with means to releasably retain a hose nozzle.

* * * * *